US006283872B1

(12) United States Patent
Lichodziejewski et al.

(10) Patent No.: US 6,283,872 B1
(45) Date of Patent: Sep. 4, 2001

(54) TOY BOWLING GAME

(75) Inventors: Michael Lichodziejewski, Schaumburg; Seum Lim Gan, Villa Park; Craig Dennis Sellers, Chicago; John Wildman, Wilmette, all of IL (US); Scott S. Clark, Manchester, CT (US); Karl R. Meyer, Gloucester, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/593,432

(22) Filed: Jun. 14, 2000

(51) Int. Cl.[7] ..... A63D 3/00
(52) U.S. Cl. ..... 473/54; 473/116
(58) Field of Search ..... 473/54, 67, 102, 473/116; 273/127 A, 359, 371, 374, 378, 393; 446/298, 330

(56) References Cited

U.S. PATENT DOCUMENTS

| | | | |
|---|---|---|---|
| 709,802 | | 9/1902 | Shipham . |
| 2,421,279 | | 5/1947 | Marty . |
| 3,117,785 | | 1/1964 | Colton et al. . |
| 3,456,950 | | 7/1969 | Goldfarb . |
| 4,488,373 | | 12/1984 | Glickson et al. . |
| 4,832,339 | * | 5/1989 | Danielak et al. . |
| 5,009,418 | | 4/1991 | Chuan-Tien . |
| 5,135,221 | | 8/1992 | Barlow . |
| 5,193,819 | * | 3/1993 | Chen . |
| 5,288,069 | | 2/1994 | Matsumoto . |
| 5,679,047 | | 10/1997 | Engel . |

* cited by examiner

*Primary Examiner*—William M. Pierce
(74) *Attorney, Agent, or Firm*—Barlow, Josephs & Holmes

(57) ABSTRACT

An animated toy bowling game includes a plurality of pins, a base having a plurality of pin sockets therein, and a toy bowling ball. The pins have fanciful character faces that give the pins the appearance of live characters. Each of the pins is receivable in a respective pin socket for locating the pins in a specified pin arrangement. Each of the pin sockets includes a pin sensor for determining whether a pin is received therein and an actuator element engageable with the respective pin received therein to move, or wobble, the respective pin when the actuator element is moved into and out of engagement with the pin. The game further includes a drive device to effect movement of the actuator elements, and an audio unit operative for producing audible sounds. The sensors, drive device, and audio unit are coupled to a control unit operative for selectively controlling the drive device and the audio unit responsive to detection of the states of the pin sensors. During game play, the pins are wobbled to simulate apparent live movement of the pin characters and the game produces audible sounds including announcements of the player's score and taunting phrases.

16 Claims, 9 Drawing Sheets

TOY BOWLING GAME

BACKGROUND AND SUMMARY OF THE INVENTION

The instant invention relates to children's toy bowling games and more particularly to an animated and interactive children's toy bowling game wherein the toy produces audible sounds including announcements of the player's score and taunting phrases such that the bowling pins appear to speak to the players during game play, and further wherein the pins are made to wobble or shake during game play to simulate live movement of the pins.

Children's bowling games have heretofore been known in the art. In this regard, the U.S. Pat. No. 709,802 to Shipham and Barlow U.S. Pat. No. 5,135,221 represent the closest prior art to the subject invention of which the applicant is aware.

The U.S. Patent to Shipham discloses a bowling alley having a base and a plurality of pins which are adapted to be repositioned or reset in an upright position by means of tethers attached to the pins. As is well known in the art, the task of resetting the pins to the upright position is an important issue in the play value of a bowling toy. Any system which allows a simple and effective mechanism for resetting the pins adds to the play value of the toy. In this regard, the player is able to pull on a single tether cord and reset the pins to an upright position after each turn.

The U.S. Patent to Barlow discloses a table top bowling game including a base having an alley, a platform above the end of the alley and a plurality of posts on the platform arranged in a pattern similar to the pattern of pin placement in a bowling alley. Each post receives and supports a small scale replica of a bowling pin. Each pin has a spring which normally biases the pin upwardly away from the post. However, each post further includes a hook to maintain the pins in engagement with the posts against the bias of the springs. A plurality of targets are arranged in the alley below the associated posts. A sliding puck is provided for engaging the targets, wherein striking of the targets causes the pins to be released from the posts to "pop" upwardly, thus simulating striking of the pins. The pins are reset by pushing the pins downwardly back into engagement with the posts.

The U.S. Pat. No. 3,117,785 to Colton further represents prior art in the subject invention in that it discloses a bowling pin scoring mechanism wherein switches are utilized to determine if the pin has been knocked over, and to thus automatically track scoring. The switches are imbedded in the pin deck of the floor of the alley and operate either by spring bias or photoelectric detectors. Scoring is automatically detected by release of the switch when a pin is knocked down.

The toy bowling game of the present invention includes a base having six upwardly opening sockets therein and six bowling pins which are receivable in the sockets. Provided within each of the sockets is a sensor for determining whether a pin is received in the socket, and an actuator that engages the pin and causes the pin to wobble during game play. The toy bowling game further includes a control system associated with the sensors and the actuators for controlling operation thereof and for tracking score and game play. The toy bowling game still further includes an audio system operative for producing audible sound effects, such as the crash of bowling pins, clapping and cheering, and voice sounds such as announcement of the players score, game instructions and humorous taunting phrases.

More specifically, the pins have a body portion fashioned in the shape of conventional bowling pins and further have fanciful character faces that give the pins the appearance of live characters. The base includes an elevated pin deck which includes the pin sockets and a ramp at the front edge thereof to facilitate rolling of a bowling ball up onto the elevated pin deck. Each of the pins is received in a respective pin socket for locating the pins in a specified pin arrangement. The actuator elements are collectively mounted on a slide plate located in the base, beneath the pin deck. The slide plate, and actuator elements are driven in a linear reciprocating motion by a drive device and a transmission coupled between a movable drive element of the drive device and the slide plate to translate movement of the drive element into a corresponding linear reciprocating movement of the slide plate.

During game play, the pins are wobbled to simulate apparent live movement of the pin characters and the audio unit produces audible sounds including announcements of the player's score and taunting phrases such that the bowling pins appear to speak to the players during game play.

Accordingly, among the objects of the instant invention are: the provision of an animated bowling game wherein the pins appear to be live characters that interact with the players; the provision of an animated bowling game wherein the pins are caused to wobble in position to simulate movement, shaking, or jumping of the pins during game play; the provision of a toy bowling game wherein each pin socket includes a sensor for determining whether a pin is received in the socket; the provision of an animated toy bowling game wherein an audio unit associated with the pin socket sensors produces audible sounds, including bowling noises, crowd noises, announcements of the players score, and taunting phrases spoken by the pin characters responsive to detection of the states of the pin socket sensors; and the provision of a toy bowling game that is simple for young people to operate.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
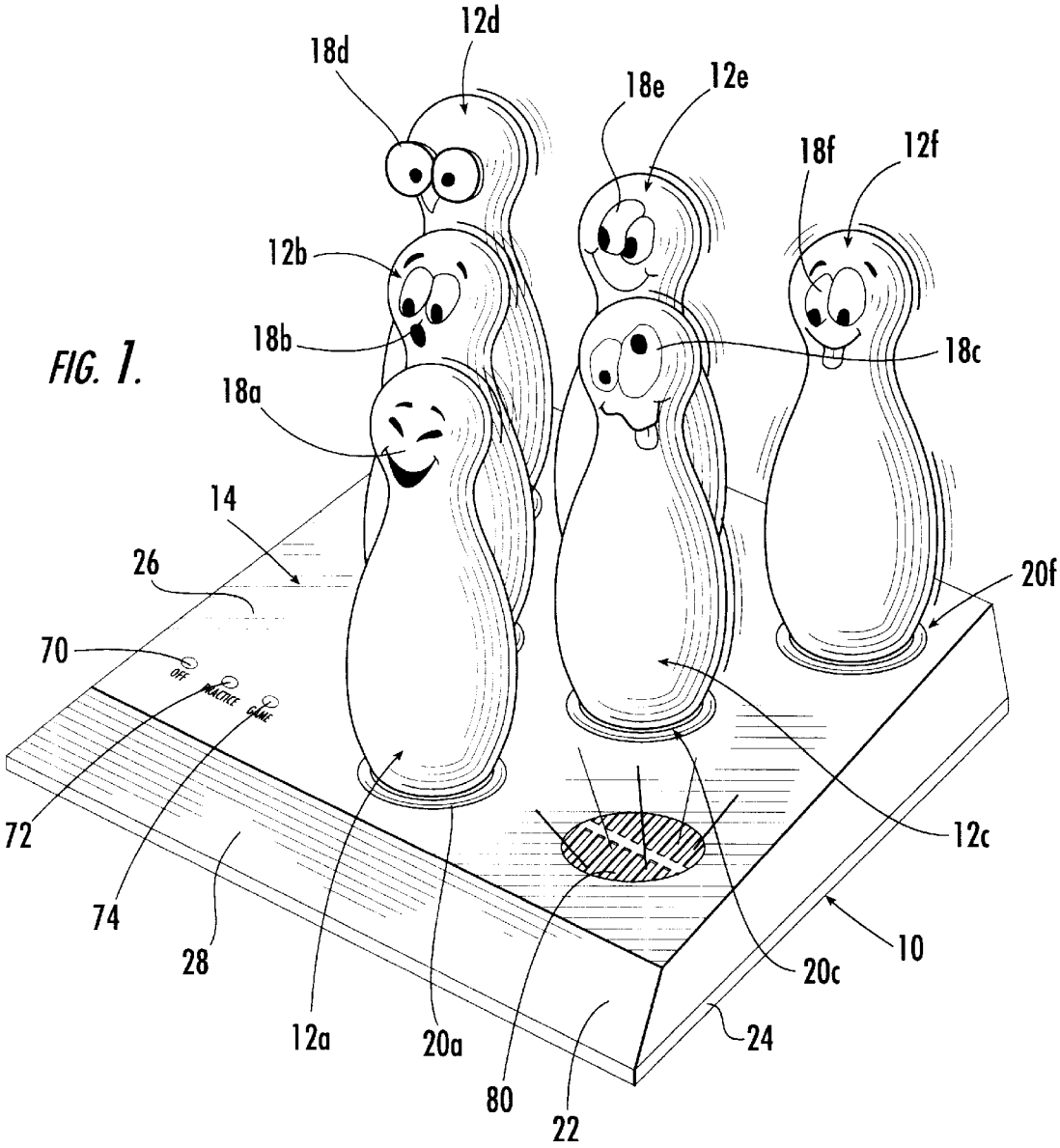
FIG. 1 is a front perspective view of the toy bowling game of the present invention.
Figure 2:
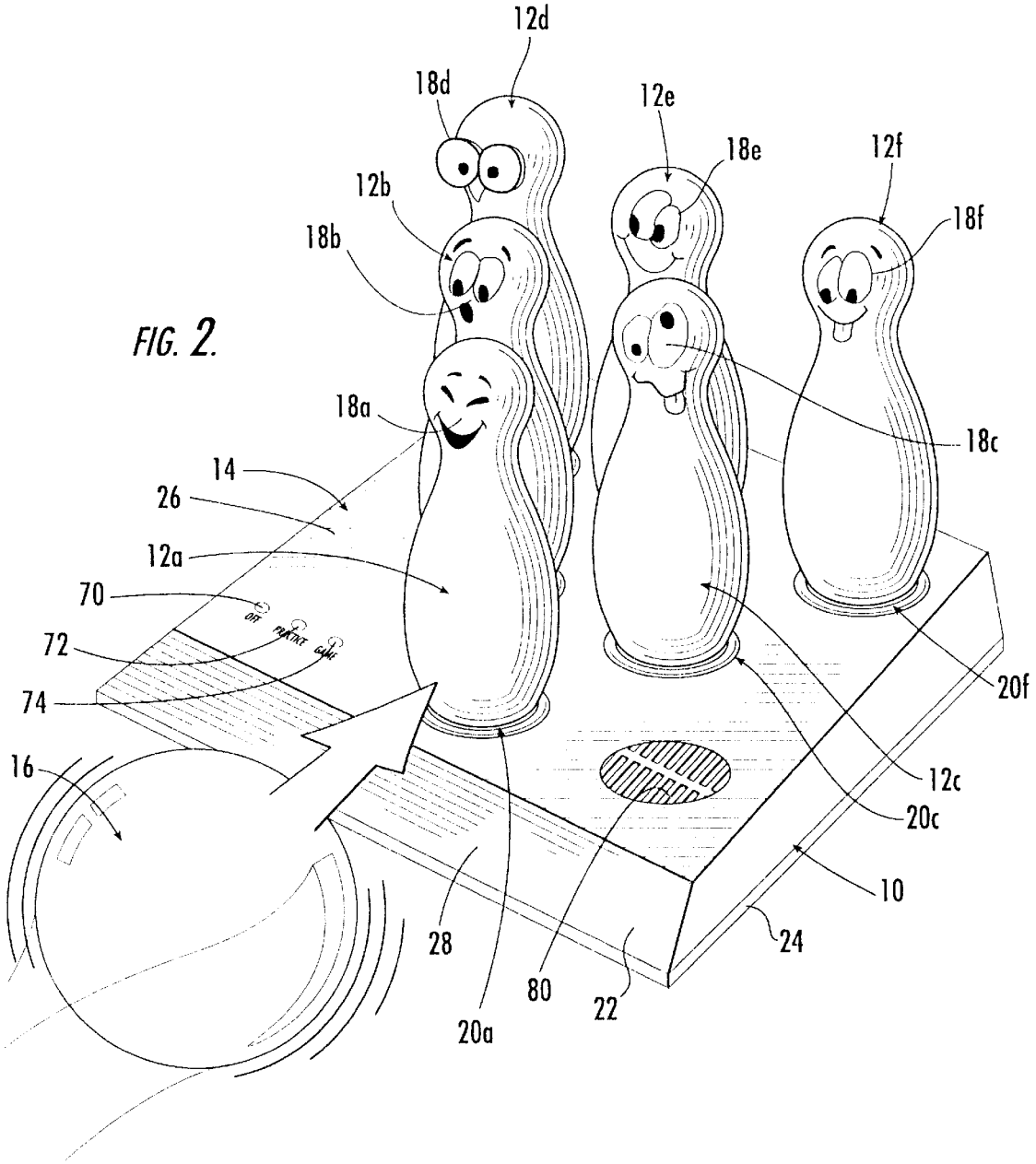
FIG. 2 is another front perspective view showing movement of the bowling ball into engagement with the pins.
Figure 3:
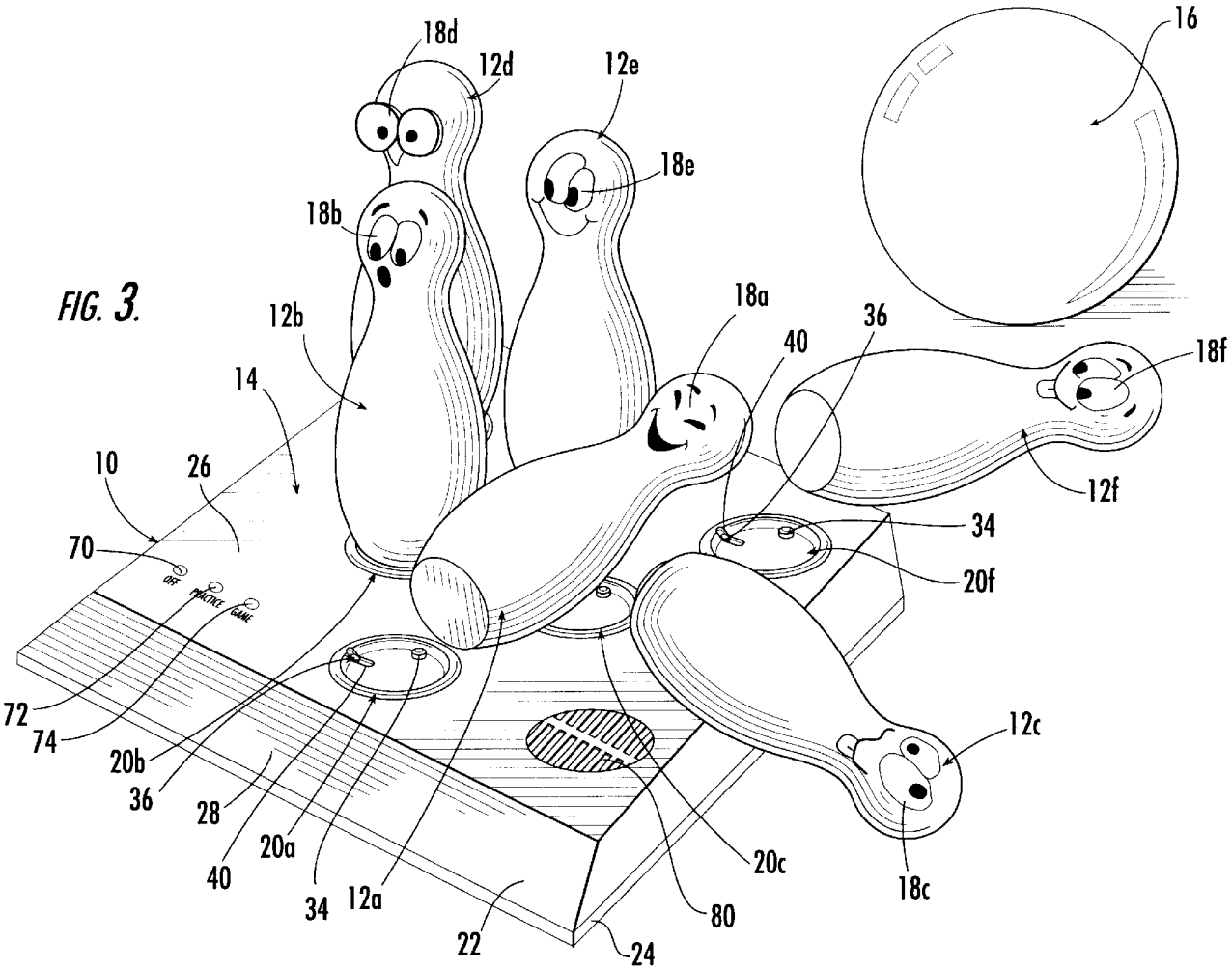
FIG. 3 is yet another front perspective view showing several of the pins knocked down and leaving others standing.
Figure 4:
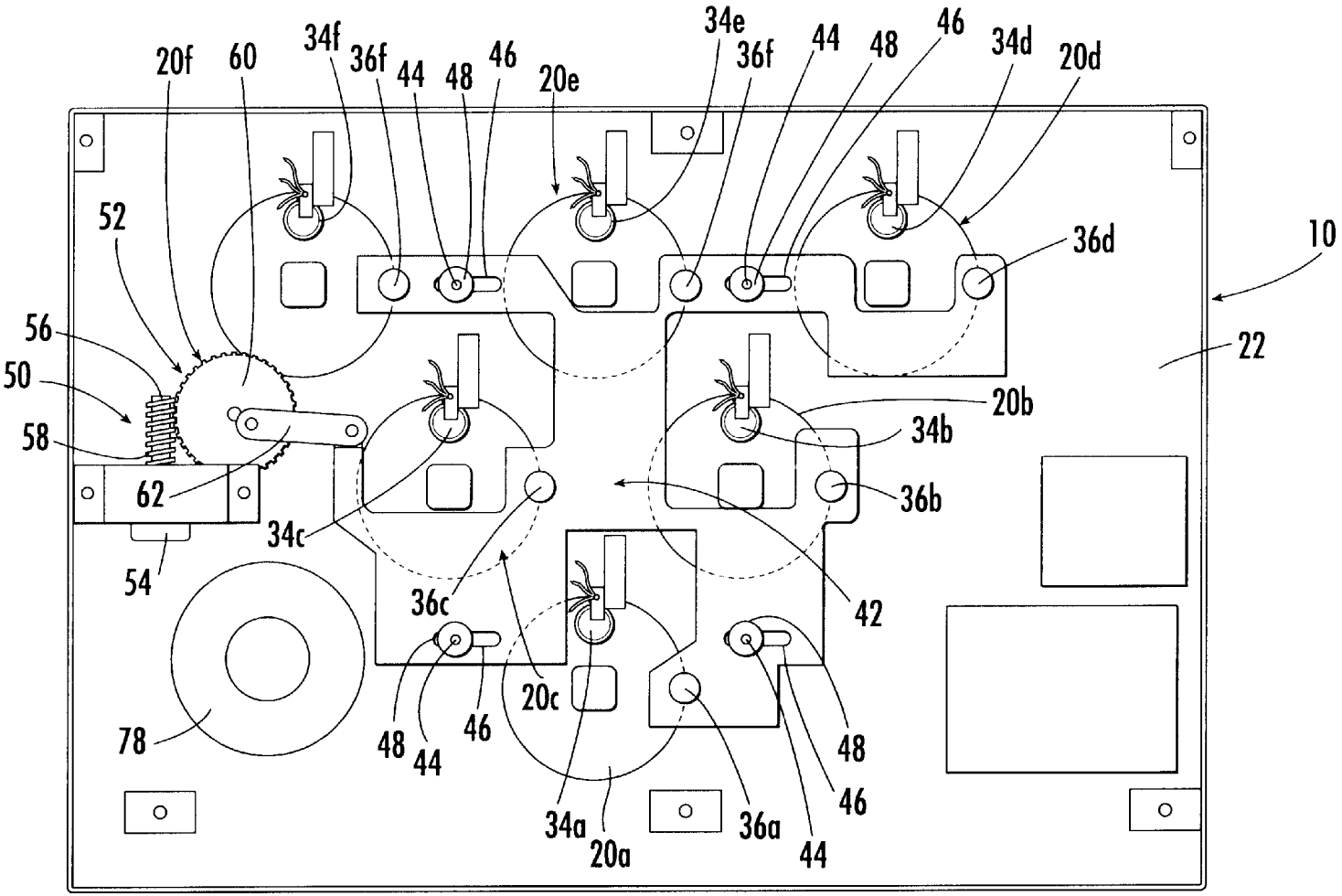
FIG. 4 is a bottom view of the base with the bottom cover removed for purposes of illustrating the slide plate operative for movement of the pins.
Figure 5:
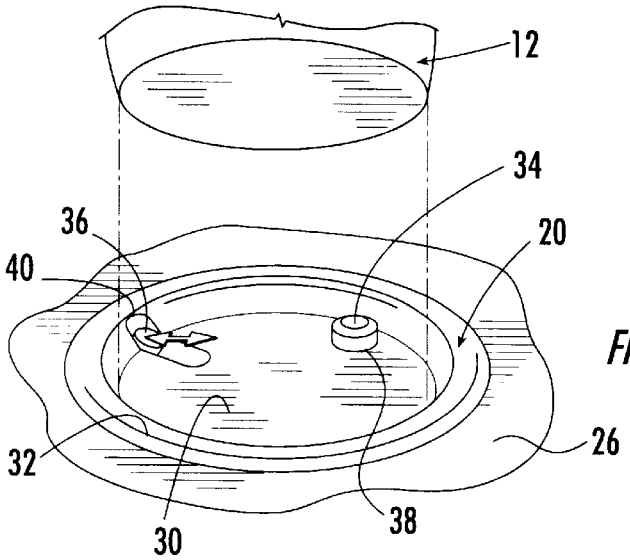
FIG. 5 is an enlarged fragmentary perspective view of one of the pin sockets in the base.
Figure 6:
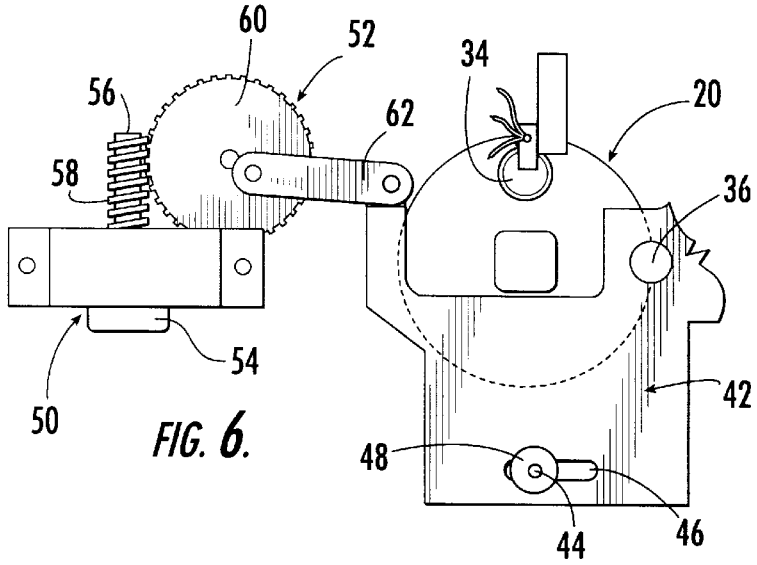
FIGS. 6–7 are schematic illustrations of the drive mechanism for driving movement of the slide plate.
Figure 7:
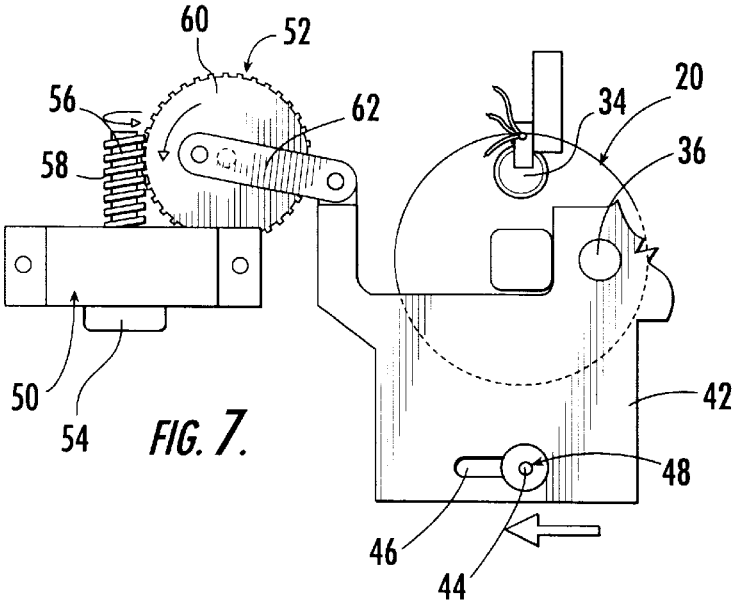
Figure 8:
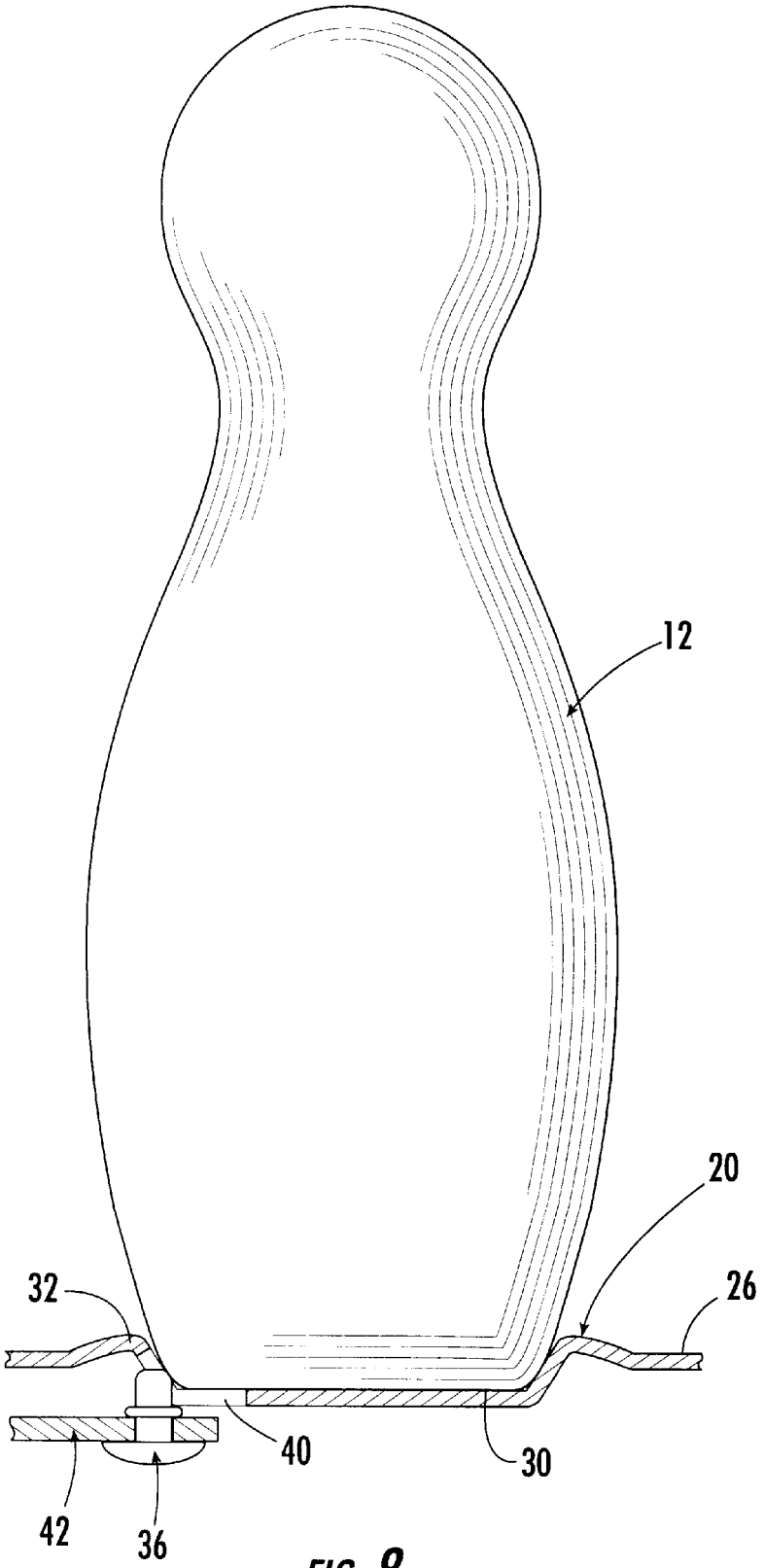
FIGS. 8–10 are cross-sectional views of one of the pin sockets showing movement of the actuator element relative to a pin received in the pin socket.
Figure 9:
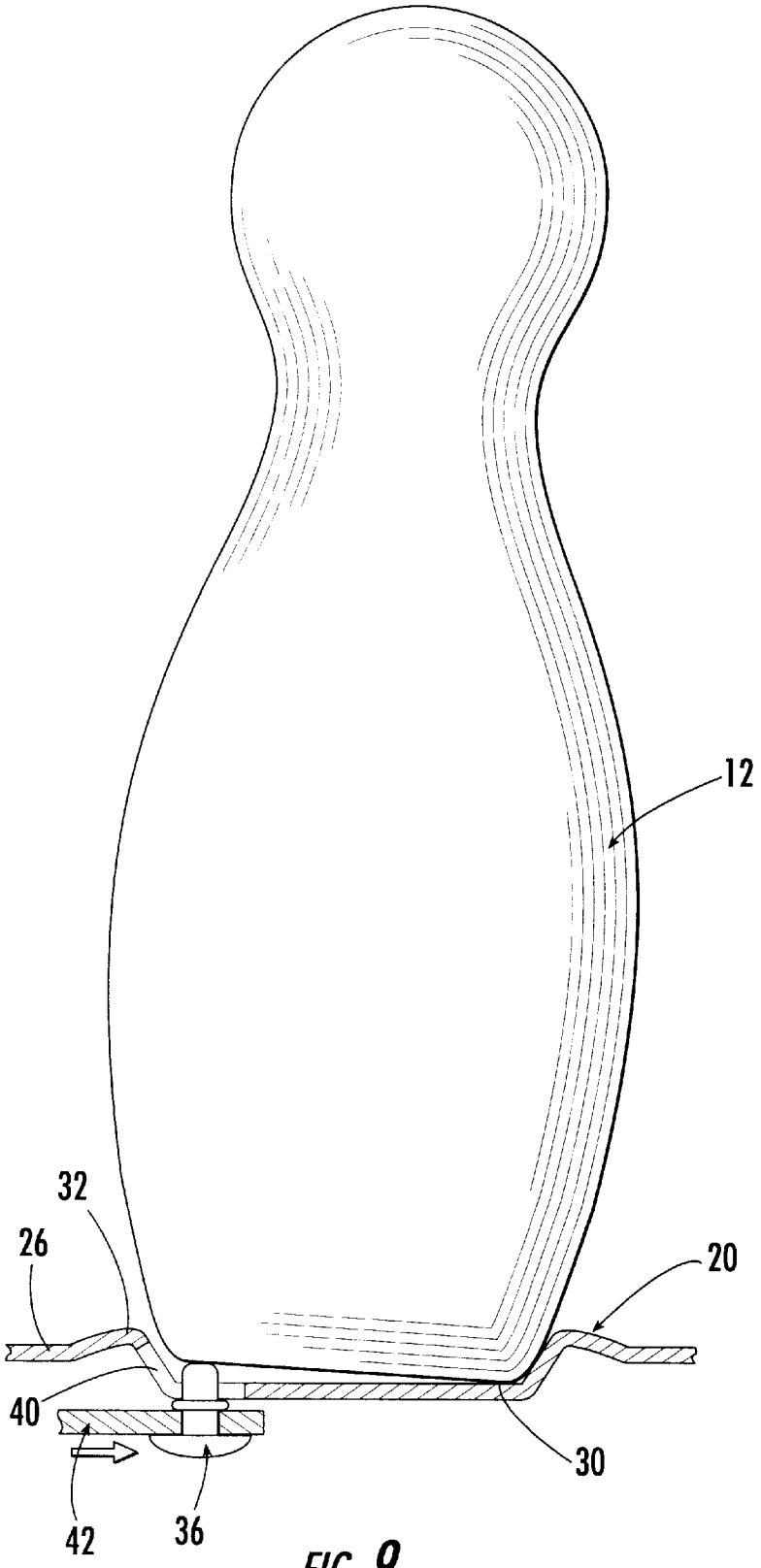
Figure 10:
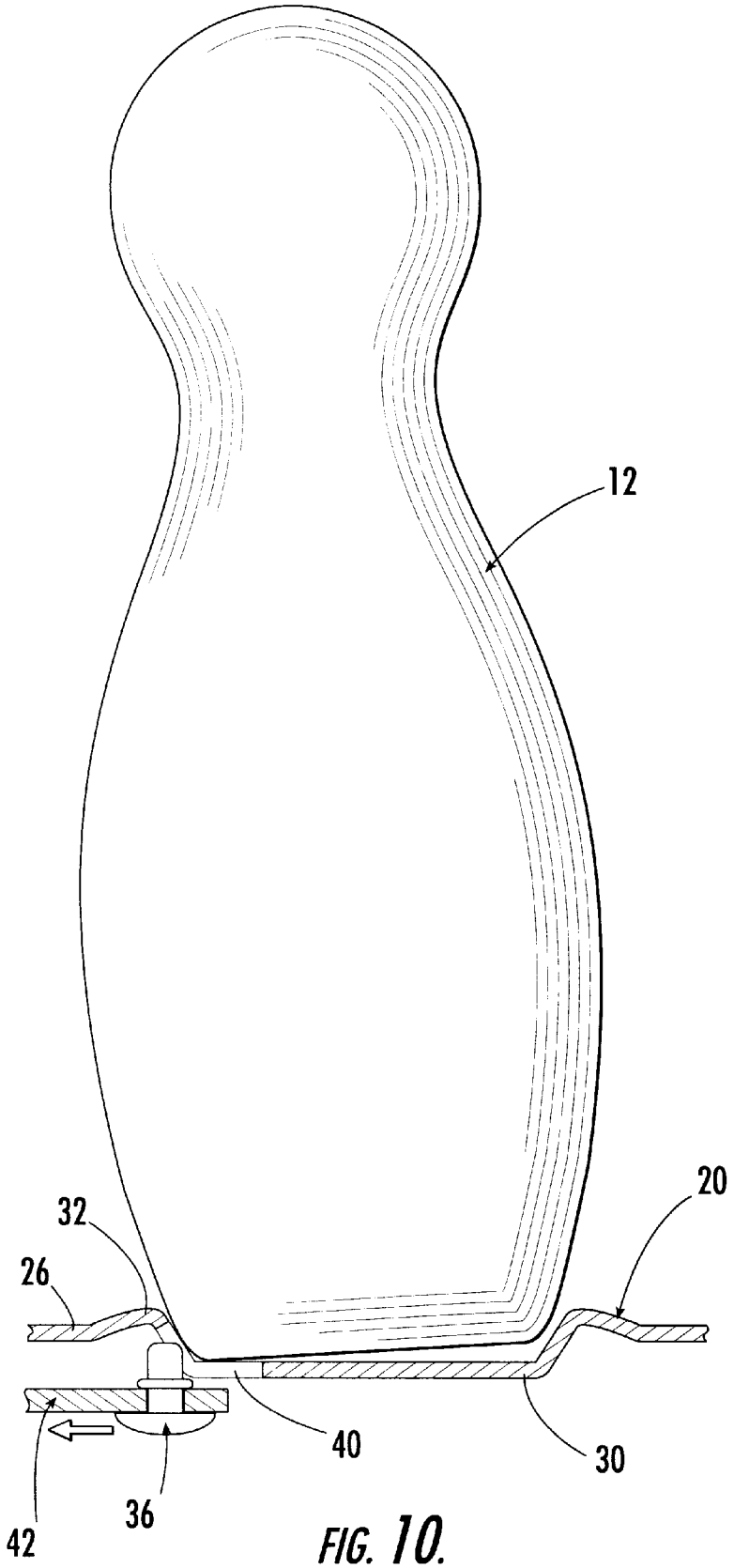

Referring now to the drawings, the toy bowling game of the instant invention is illustrated and generally indicated at 10 in FIGS. 1–11. As will hereinafter be more fully described, the instant invention provides animated and interactive children's toy bowling game 10 wherein the toy produces audible sounds including announcements of the player's score and taunting phrases such that the bowling pins appear to speak to the players during game play, and further wherein the pins are made to wobble during game play to simulate live movement of the pin characters.

The scope of the present invention is not intended to be limited by the recitation of any particular type of preferred material for any particular component part, nor by the recitation of any preferred fabrication method. Unless otherwise indicated herein, it is preferred that the major component elements of the present invention be molded or otherwise fabricated from a child safe, lightweight polymer material (plastic). However, it is to be understood that other materials, such as metal, or polymer composite materials are equally as effective. Individual force bearing components such as gear shafts, and pivot pins, etc. are preferably fabricated from metal, although such components could alternatively be fabricated from plastic materials as well.

The animated toy bowling game 10 includes a plurality of pins generally indicated at 12*a*–12*f*, a base generally indicated at 14, and a toy bowling ball generally indicated at 16.

Each of the pins 12*a*–12*f* has a body portion fashioned in the shape of a conventional bowling pin, and includes a fanciful character face 18*a*–18*f* that gives the individual pins 12 the appearance of live characters. Each pin 12*a*–12*f* represents a different character and may be provided with a different color, or color scheme, as preferred. Each of the pins 12 is received in a respective pin socket 20*a*–20*f* on the base 14 for locating the pins 12 in a specified pin arrangement. In this regard, the pins 12*a*–12*f* and the pins sockets 20*a*–20*f* may be correspondingly color coded for consistent alignment and location of the pins 12 on the base 14, although it is to be understood that such color coding is not critical to the inventive or novel aspects of the invention.

The base 14 includes upper and lower section halves 22, 24 respectively that are interfittingly engaged and secured to form a housing having an open interior portion. The lower section half 24 forms a flat support structure for supporting the base 14 on a supporting surface. The upper section 22 half includes a pin deck 26 that includes the pin sockets 20, and a ramp 28 at the front edge thereof to facilitate rolling of the bowling ball 16 up onto the pin deck 26.

Each of the pin sockets 20 is integrally formed into the surface of the upper pin deck 26 of the base 14 and includes a recessed bottom wall 30 and a raised shoulder 32 surrounding the bottom wall 30. The pin socket 20 is intended to form a seat for the pin 12 to be held in an upright standing position as would normally be presented for bowling. In general, there are preferably six pin sockets 20 to match the six pins 12 provided, and the pin sockets 20 are arranged in a conventional triangular bowing pin configuration with a single pin socket 20*a* located at the front of the pin deck 26 followed by a second row of two pin sockets 20*b*,20*c* and a third row of three pin sockets 20*d*, 20*e*, 20*f*. Each of the pin sockets 20 includes a pin sensor 34*a*–34*f* for determining whether a respective pin 12*a*–12*f* is received in the respective pin socket 20*a*–20*f*, and an actuator element 36*a*–36*f* engageable with the pin 12*a*–12*f* received in the pin socket 20*a*–20*f* to move, or wobble, the respective pin 12 when the actuator element 36 is moved into and out of engagement with the pin 12.

For purposes of the remainder of the disclosure, the pin sockets 20*a*–20*f*, pin sensors 34 and actuator elements 36 are all identical in construction, and for simplicity will be identified in certain instances only by their general reference number. The pin sensors 34 preferably comprise an electrical push-button switch mounted in the bottom wall 30 of the pin socket 20. More specifically, the sensors (switches) 34 are mounted to the underside surface of the pin deck 26 so that the push button portion of the switch 34 extends upwardly through an opening 38 (See FIG. 5) in the bottom wall 30 of the pin socket 20.

The pin sensors 34 are of a type that are normally biased to an open position by a spring (not shown), such that the switch 34 will be in an open position when the pin 12 is not received in the socket 20, and will be in a closed position when the pin 12 is received in the pin socket 20. In this regard, the sensor 34 has a spring which has only a very light upwardly biasing force so that the small weight of the toy pin 12 is sufficient is depress the switch button and close the sensor 34 when the pin is received in the pin socket 20.

The actuator elements 36 are formed in the shape of a small post that extends upwardly through an elongated slot 40 also formed in the bottom wall 30 of the pin socket 20. The slot 20 extends from the shoulder 32 of the pin socket 20 into the peripheral edge portion of the pin socket 20 so that as the actuator element 36 linearly slides back and forth in the slot 40, the actuator element 36 is moved into and out of engagement with the bottom of the pin 12. In this regard, all of the actuator elements 36 are collectively mounted to a planar slide plate 42 received within the base 12 beneath the pin deck 26. The slide plate 42 is slidably mounted on a plurality of pins 44 that extend through corresponding slots 46 formed in the slide plate 42. The pins 44 extend downwardly from the underside of the pin deck 26, and extend through the laterally extending slots 46 in the slide plate 42. Fasteners 48 are received over the ends of the pins 46 to capture the slide plate 42 in assembled relation with the pins 44. Sliding movement of the slide plate 42 back and forth along the slots 46 provides for synchronized reciprocating movement of the actuator elements 36 into and out of engagement with the pins 12.

The toy further includes a drive device generally indicated at 50 and a transmission assembly generally indicated at 52 coupled between the drive device 50 and the slide plate 42 to translate movement of the drive device 50 into linear movement of the actuator elements 36. The drive device 50 preferably comprises an electric motor 54 having a rotating drive shaft 56. The transmission assembly 52 includes a worm gear 58 mounted on the drive draft 56, a drive gear 60 meshed with the worm gear 58 and a connecting arm 62 pivotably connected at one end to the slide plate 42, and pivotably connected at the second end to a peripheral edge of the drive gear 60. In this regard, eccentric rotation of the first end of connecting arm 62 (see FIGS. 6 and 7) translates into a linear motion (see arrow in FIG. 7) of the second end of the connecting arm 62 thereby driving a reciprocating linear motion of the slide plate 42, and corresponding linear motion of the actuator elements 36 (See FIGS. 8–10). Although a specific embodiment of the actuator elements 36, slide plate 42, an electric motor 54, transmission gears 58,60 and connecting arm 62 are illustrated and described herein, it is to be understood that other mechanical and electrical drive arrangements are also suitable within the context of the present invention as long as there is some inherent mechanism to selectively drive an actuator element 36 into and out of engagement with the pin 12 to cause a wobbling motion thereof. This would include mechanical drive mechanisms that are not electric or electronic in nature.

In order to provide control of the drive motor 54 and sound effects during game play, the toy 10 includes an integrated control system generally indicated at 64 and an audio unit generally indicated at 66 operative for producing audible sounds. The control unit 64 includes a microcontroller 68 or other electronic control device programmed with an appropriate software scheme designed for operation of the device 10 responsive to various switch inputs (34*a*–34*f*). Microcontrol devices 68 of the type contemplated herein are well known in the art, and no further description thereof is believed to be necessary for one skilled in the art to assemble and operate the present device. In this regard, the device 10 further includes three mode switches 70, 72,74 that control primary functionality of the control device 64. These switches include an on/off switch 70, a practice mode switch 72 and a game mode switch 74.

The audio unit 66 preferably comprises an integrated speech synthesizing circuit 76, and a speaker 78. The speaker 68 is mounted to the bottom surface of the pin deck 26 and audio output from the speaker 68 passes through a plurality of openings 80 in the pin deck. The relevant electronics include electronic elements (not shown) which are suitable for either synthesizing desirable audio output or for outputting the desired audio from memory or other storage devices. Speech synthesizing devices 76 of the type contemplated within the scope of the invention are well known in the electronics arts and no further description thereof is believed to be necessary for one skilled in the art to assemble and operate the present device. Preferably, the relevant electronics for driving the motor 54 and for the audio system 76 are integrated into the same circuit board (not shown). The electronic components of the system are powered by battery elements 82 housed within the base, and connected by wires to the relevant circuits (See FIG. 11).

Figure 11:
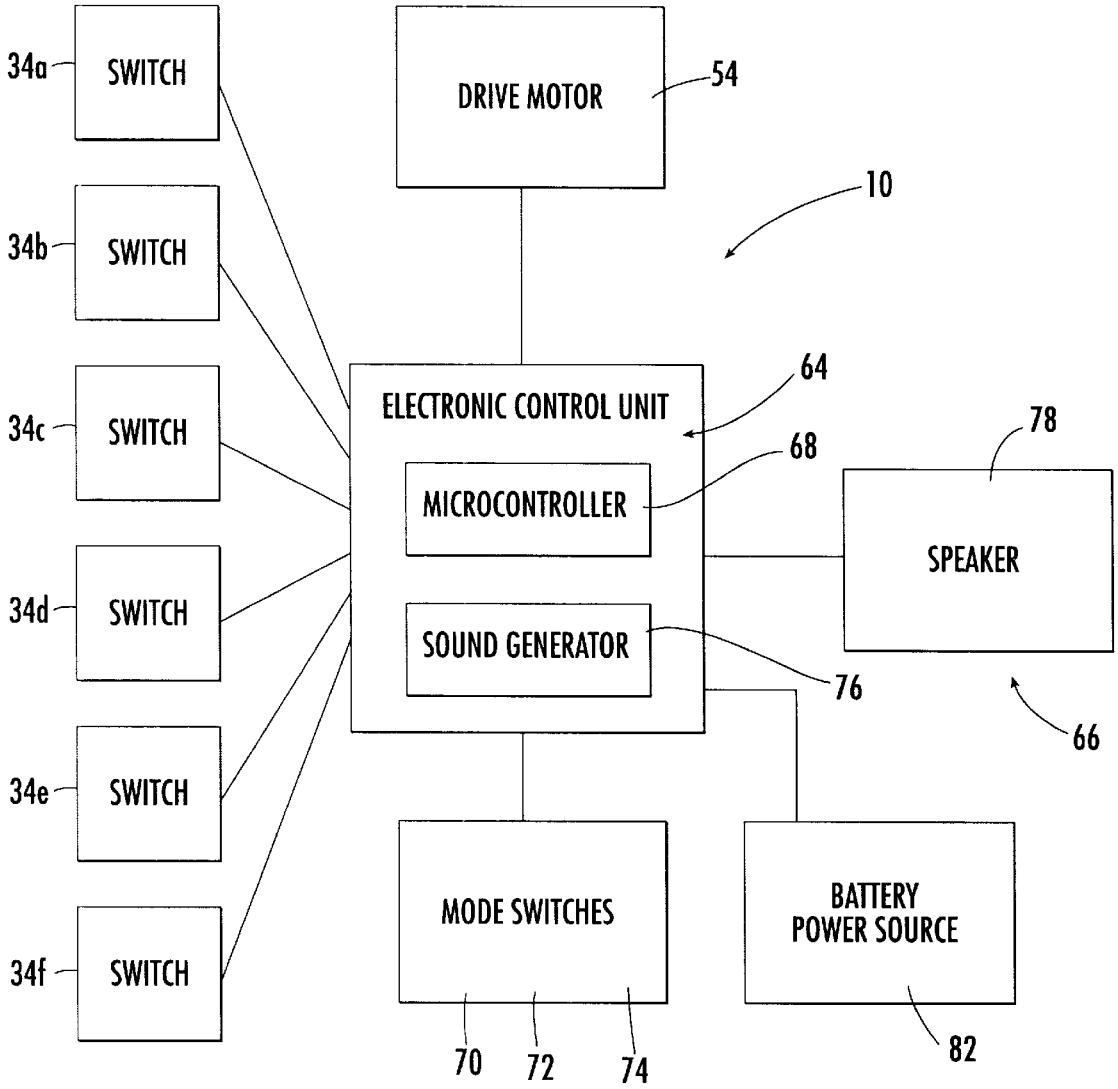
FIG. 11 is a schematic block diagram of the electronic components of the invention.

The pin sensors 34, drive device 50, and audio unit 66 are coupled to the control unit 64 for selectively controlling the drive device 50 and the audio unit 66 at least partially responsive to detection of the states of the pin sensors 34 (See FIG. 11).

Generally speaking, during game play, the pins 12 are caused to wobble to simulate apparent live movement of the pin characters and the audio unit 66 produces audible sounds including announcements of the player's score and taunting phrases such that the bowling pins 12 appear to speak to the players during game play. The audio and motion of the pins is intended to attract and maintain attention of the young children longer than otherwise possible with a passive system.

A representative example of a game play scenario and sequence of outputs is described hereinbelow. However, the description of this particular scenario is not intended to limit the potential scope of other operational schemes possible using the available components.

Example of Play Scheme

The base has three buttons on top:

1) Off—Turns the game off,

2) Practice Button—Turns game on and enters Practice Mode.

Practice mode lets the player just throw the ball down to hear the sounds. It does not call out a score but does reward the player with a Strike and associated sound effects. If the player knows down every pin one turn, they get a Strike reward. Proceed to 1. Start 3) Game Button—Turns game on and enters Game Mode.

In this mode, each player from 1 to many has the opportunity to get two hits. The game cannot register misses (or gutter balls). Therefore, the score is called out after a players hits two sets of pins (unless they get a strike the first time). Basically, player 1 rolls the ball and hits some pins down. If they don't get a strike, then they roll the ball again to know down some more. They get as many tries as it takes to knock down two sets of pins. After the second set of pins is knocked down, the score or "Spare!" is called out. The game does not keep a record of scores. Proceed to 1. Start 1. Start (turn the game on by pressing either Practice or Game:

As soon as either Practice of Game is pressed:

"<Bowling Pins Crash Sound>"

A. If Practice was pressed:

If any pins are not standing up then enter the Setup Mode:

"Set us up to"

"Play"

The game now enters a loop where it is constantly checking to see if all the pins are set up.

If a button is pressed to register that a pin was set onto it, that pin's phrase from the <Pin Setup> section is spoken. After the phrase is spoken, go back to 1A. Practice The game randomly selects 3, 4 or 5 seconds. If nothing happens in the chosen time then it randomly selects a phrase from one of the following four lines of script (selected from the <Taunts> section of the script):

"It's very quiet down here!"

"Why isn't anything happening?"

"<Snoring>"

"Set us up to" & "play!"

It needs to remember the previous 3 taunts to reduce repetition.

Pins Shake for 2.5 seconds

"Let's practice!"

Go to the 2. Practice Mode section.

B. If Game was pressed:

If any pins are not standing up then enter the Setup Mode:

"Set us up to"

"Play!"

The game now enters a loop where it is constantly checking to see if all the pins are set up.

If a button is pressed to register that a pin was set onto it, that pin's phrase from the <Pin Setup> section is spoken. After the phrase is spoken, go back to 1B. Game The game randomly selects 3, 4 or 5 seconds. If nothing happens in the chosen time then it randomly selects a phrase from one of the following four lines of script (selected from the <Taunts> section of the script):

"It's very quiet down here!"

"Why isn't anything happening?"

"<Snoring>"

"Set us up to" & "play!"

It needs to remember the previous 3 taunts to reduce repetition.

Pins shake for 2.5 seconds

"Let's play a game!"

Go to the 3. Game Mode section.

2. Practice Mode:

At this point, the game is waiting for a player to knock some pins down. The player could also be rolling the ball and completely missing the platform. The game randomly selects 3, 4 or 5. If nothing happens for that number of seconds, then randomly select a phrase from the <Taunts> section of the script. (If all of the pins are still standing, then one of the Taunts could also be the Pins Shaking for 2 seconds). The game needs to remember the previous 3 taunts to reduce repetition. Continue to taunt every 3 to 5 seconds until some pins are knocked down.

If some pins re knocked down:

When some pins are knocked down, the game counts how many are left standing to see if they got a strike or not.

If no pins are left standing:

If no pins were knocked down yet (all six pins were knocked down at once):

"<Bowling Pins crash Sound>"

"Strike!"

"<Full Reward>"

"<Crowd Cheer>"

return to the 1A. Practice section.

If some pins were already knocked down from a previous throw:

<Bowling Pins Crash Sound>"

"<Crowd Cheer>"

return to the 1A. Practice section.

If some pins are still standing:

The remaining pins each speak their phrases from the <Pins Left Standing> section. They should always be spoken sequentially so the player can identify a phrase with a pin.

If the player sets a pin back up before all of the mare knocked down, as soon as that pin is registered on the base, speak it's <Pin Setup> phrase. After the phrase is done return to 1A. Practice.

3. Game Mode:

At this point, the game is waiting for a player to knock some pins down. The player could also be rolling the ball and completely missing the platform. The game randomly selects 3, 4 or 5. If nothing happens for that number of seconds, then randomly select a phrase from the <Taunts> section of the script. (If all pins are still standing, then one of the Taunts could also be the Pins Shaking for 2 seconds). The game needs to remember the previous 3 taunts to reduce repetition. Continue to taunt every 3 to 5 seconds until some pins are knocked down.

If some pins are knocked down:

After the first set of pins knocked down, the game counts how many are left standing to see if they got a strike or not.

If this is the player's first hit:

If all the pins were knocked down:

"<Bowling Pins Crash Sound>"

"Strike!"

"<Full Reward>"

"<Crowd Cheer>"

return to the 1B. Game section.

If only some of the pins were knocked down:

"<Bowling Pins Crash Sound>"

The remaining pins each speak t heir phrases from the <Pins Left Standing> section of the script. They should always be spoken sequentially and in the same order so the player can identify a phrase with a pin.

go back to 3. Game Mode.

If this is the player's second hit:

If all of the remaining pins were knocked down:

"<Bowling Pins Crash Sound>"

"Spare!"

"<Crowd Cheer>"

return to the 1B. Game section.

If only some of the pins were knocked down:

"<Bowling Pins Crash Sound>"

The remaining pins each speak their phrases from the <Pins Left Standing> section. They should always be spoken sequentially and in the same order so the player can identify a phrase with a pin.

The game counts the number of pins knocked down

"Great!"

"You got a"

"2" or "3" or "4" or "5" (the remaining pins)

return to the 1B. Game section.

If the player sets a pin back up before all of them are knocked down, as soon as that pin is registered on the base, speak it's <Pin Setup> phrase and then return to 1B. Game.

4. Off:

Pressing the Off button turns the game off. No sound is played and no shaking occurs, although the user can still bowl, knock the pins down and set them back up.

5. Resetting the game:

On the off chance that the game continues to hang, the parent would need to remove the batteries and reinsert them. Again, the game will be off, so the player would then have to press the Practice of Game button to begin play.

Sample audio script

| | Sound Effects | Situation |
|---|---|---|
| 1 | <Bowling Pins Crash Sound> | Pins down |
| 2 | <Comedy drum beat> | Pin Setup |
| 3 | <Crowd Cheer> (looping> | Scoring |
| 4 | <Full Reward> | Scoring |
| | Starting Game | Character |
| 5 | Let's practice! | a |
| 6 | Let's play a game! | b |
| | Pin Setup | |
| 7 | I'm smarter than your average pin you know | b |
| 8 | Can I go? Please? | a |
| 9 | Oh No! I've got to stand here again. | c |
| 10 | Go ahead. Take your best shot | d |
| 11 | Hey! Let's get the ball rolling (+<Comedy Drum Beat>) | e |
| 12 | Duh!]I like bowling. | f |
| | Taunts | |
| 13 | Roll that ball down here. | a |
| 14 | You throwing that ball at me? | d |
| 15 | It's very quiet down here! | c |
| 16 | Why isn't anything happening? | b |
| 17 | Stop giggling and knock us down! | e |
| 18 | <Snoring> | f |
| | Pins Left Standing | |
| 19 | Good thing I saw that coming. | b |
| 20 | Nice shot. But I'm still here! | e |
| 21 | err! Where did they go? | f |
| 22 | Woo Hoo! I made it! | a |
| 23 | Is that all you've got? | d |
| 24 | That was really close! | c |
| | Scoring | |
| 25 | You got a | b |
| 26 | 2 | b |
| 27 | 3 | b |
| 28 | 4 | b |
| 29 | 5 | b |
| 30 | Strike! | a, b, c, d, e, f |

-continued

| Sample audio script | | |
|---|---|---|
| 31 | Spare! | a, b, c, d, e, f |
| 32 | Great! | a |
| 33 | Set us up to | a |
| 34 | play! | a |
| 35 | play again! | a |

It can therefore be seen that the present invention provides a unique and amusing toy bowling game. The use of actuator elements for causing rocking or wobbling movement of the pins effectively simulates live movement, such as shaking, jumping or dancing of the pins during game play. Furthermore, the use of an integrated sound unit coupled to pin socket switches gives the ability to produce audio output that is tailored to and consistent with actual game play. The combination of both movement of the pins and apparent audio output from the pins provides for enjoyable, and unpredictable game play for young children. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy bowling game comprising:

a plurality of pins;

a base having a plurality of upwardly opening pin sockets therein, each of said plurality of pins being receivable in a respective one of said pin sockets, each of said pin sockets including a pin sensor determining whether a pin is received therein, each of said pin sockets further including an actuator element engageable with a respective pin received therein for causing the respective pin received therein to move when said actuator element is moved into and out of engagement therewith;

a drive device effecting movement of said actuator elements; and a control unit coupled to said drive device for selectively controlling said drive device.

2. The toy bowling game of claim 1 wherein said control unit is further coupled to said sensors, said control unit being operative, at least partially responsive to said sensors, for selectively controlling said drive device to effect movement of said actuator elements.

3. The toy bowling game of claim 2 further comprising an output device, said control unit being further coupled to said output device and being operative, at least partially responsive to said sensors, for selectively controlling said drive device to effect movement of said actuator elements and for selectively controlling said output device to produce an output therefrom.

4. The toy bowling game of claim 3 wherein said output device comprises an audio unit operative to produce audible sounds.

5. A toy bowling game comprising:

a plurality of pins;

a base having a plurality of upwardly opening pin sockets therein, each of said plurality of pins being receivable in a respective one of said pin sockets, each of said pin sockets including a pin sensor having a first state when a pin is received therein, and second state when a pin is not received therein, each of said pin sockets further including an actuator element engageable with a respective pin received therein for causing said respective pin received therein to move when said actuator element is moved into and out of engagement therewith;

a drive device having a movable drive element;

a transmission coupled between said movable drive element and said actuator elements translating movement of said movable drive element into a corresponding movement of said actuator elements; and a control unit coupled to said sensors, said drive device, and said audio unit wherein said control unit is operative, at least partially responsive to detection of said first and second states of said sensors, for selectively controlling said drive device to effect movement of said actuator elements and for selectively controlling said audio unit to effect an audio output therefrom.

6. The toy bowling game of claim 5 further comprising a toy bowling ball for selectively engaging said pins on said base.

7. The toy bowling game of claim 5 wherein said base includes a pin deck portion, said pin sockets being disposed on said pin deck portion of said base.

8. The toy bowling game of claim 7 wherein said base further includes front and rear ends, said pin deck being arranged at said rear end thereof, said base still further including an upwardly angled ramp portion arranged at said front end thereof.

9. The toy bowling game of claim 5 wherein said actuator elements are collectively attached to a slide plate slidably mounted within said base.

10. The toy bowling game of claim 9 wherein said transmission comprises a drive gear rotatably driven by said movable drive element and a connecting arm pivotably connected at a first end thereof to a peripheral edge of said gear and pivotably connected at a second end thereof to said slide plate.

11. A toy bowling game comprising:

a plurality of pins;

a base having a plurality of upwardly opening pin sockets therein, each of said plurality of pins being receivable in a respective one of said pin sockets, each of said pin sockets including a pin sensor having a first state when a pin is received therein, and second state when a pin is not received therein, each of said pin sockets further including an actuator element engageable with a respective pin received therein for causing the respective pin received therein to move when said actuator element is moved into and out of engagement therewith;

a drive device having a movable drive element;

a transmission coupled between said movable drive element and said actuator elements translating movement of said drive element into a corresponding movement of said actuator elements;

an audio unit operative for producing audible sounds; and a control unit coupled to said sensors, said drive device, and said audio unit wherein said control unit is operative, at least partially responsive to detection of said first and second states of said sensors, for selectively controlling said drive device to effect movement of said actuator elements and for selectively controlling said audio unit to effect an audio output therefrom.

12. The toy bowling game of claim 11 further comprising a toy bowling ball for selectively engaging said pins on said base.

13. The toy bowling game of claim 11 wherein said base includes a pin deck portion, said pin sockets being disposed on said pin deck portion of said base.

14. The toy bowling game of claim 13 wherein said base further includes front and rear ends, said pin deck being arranged at said rear end thereof, said base still further including an upwardly angled ramp portion arranged at said front end thereof.

15. The toy bowling game of claim 11 wherein said actuator elements are collectively attached to a slide plate slidably mounted within said base.

16. The toy bowling game of claim 15 wherein said transmission comprises a drive gear rotatably driven by said movable drive element and a connecting arm pivotably connected at a first end thereof to a peripheral edge of said gear and pivotably connected at a second end thereof to said slide plate.

* * * * *